United States Patent [19]

Ceresa et al.

[11] Patent Number: 4,464,541

[45] Date of Patent: Aug. 7, 1984

[54] FLAME RETARDANT PREINSULATED ELECTRICAL CONNECTOR

[75] Inventors: Myron Ceresa, Advance; Frank N. Vyas, Winston-Salem; Richard H. Zimmerman, Kernersville, all of N.C.

[73] Assignee: AMP Incorporated, Harrisburg, Pa.

[21] Appl. No.: 477,472

[22] Filed: Mar. 21, 1983

[51] Int. Cl.[3] ..... H01R 4/20

[52] U.S. Cl. ..... 174/84 C; 29/877; 29/882; 339/97 C

[58] Field of Search ..... 174/84 C; 339/97 C; 29/877, 878, 882, 883

[56] References Cited

U.S. PATENT DOCUMENTS

| | | | |
|---|---|---|---|
| 3,320,354 | 5/1967 | Marley et al. | 174/84 C |
| 3,355,698 | 11/1967 | Keller | 339/97 C |
| 3,359,531 | 12/1967 | Lau | 339/213 T |
| 3,410,950 | 11/1968 | Freudenberg | 174/84 C |
| 3,514,528 | 5/1970 | Ray | 174/84 R |
| 3,539,707 | 11/1970 | Kindell et al. | 174/84 C |
| 3,611,262 | 10/1971 | Marley | 174/84 C X |
| 3,621,117 | 11/1971 | Austas et al. | 174/84 C |
| 3,826,861 | 7/1974 | Karl et al. | 174/84 C |
| 3,912,853 | 10/1975 | Wilkes | 174/84 C |

FOREIGN PATENT DOCUMENTS

| | | | |
|---|---|---|---|
| 1225849 | 7/1960 | France | 174/84 C |

*Primary Examiner*—G. P. Tolin
*Assistant Examiner*—Morris H. Nimmo
*Attorney, Agent, or Firm*—Katherine A. Nelson

[57] ABSTRACT

An insulating sheath for preinsulated ferrule type electrical connectors having the sheath partially surrounding the ferrule is disclosed. The sheath is a two layer laminate comprised of a layer of heat resistant polyamide bonded to a layer of tetrafluoroethylene film. The polyamide layer is against the ferrule with the tetrafluoroethylene layer being the outside of the sheath. When the connector is crimped onto wires, the polyamide layer and connector are encased by the tetrafluoroethylene layer. The connector insulated with the laminate has a minimum Limiting Oxygen Index value of 28.

6 Claims, 4 Drawing Figures

FLAME RETARDANT PREINSULATED ELECTRICAL CONNECTOR

FIELD OF THE INVENTION

This invention relates to preinsulated crimpable ferrule-type electrical connectors.

BACKGROUND OF THE INVENTION

Preinsulated crimpable ferrule-type connectors have long been used to splice insulated wires, particularly the wires of telephone cables. Some connectors of this type are disclosed in U.S. Pat. Nos. 3,320,354 and 3,611,262.

Tools such as the device disclosed in U.S. Pat. No. 3,382,872 have been designed to crimp the connectors onto the wires.

This type of connector and the corresponding tools have been widely accepted by industry. While acceptable for outside use, the insulation on the original connectors is not sufficiently flame retardant to meet current industry standards for use inside buildings. These standards require an insulating material that will not support combustion and will not readily lose its insulating properties should a fire occur.

In response to the demands on industry, the present invention is directed toward the achievement of a flame retardant connector having a Limited Oxygen Index value of at least 28 as determined by testing in accordance with ASTM D2863-70.

Additional requirements were that the flame retardant connector be compatible with the present manufacturing process and crimping equipment. The invention disclosed herein meets the above requirements.

The insulating sheath is a two layer laminate comprised of a paperlike layer of heat resistant polyamide bonded to a layer of tetrafluoroethylene film. The metal ferrule is bonded to the polyamide layer. When the connector is crimped onto wires the sheath follows the ferrule, thus encasing the polyamide layer inside the tetrafluoroethylene layer.

Figure 1:
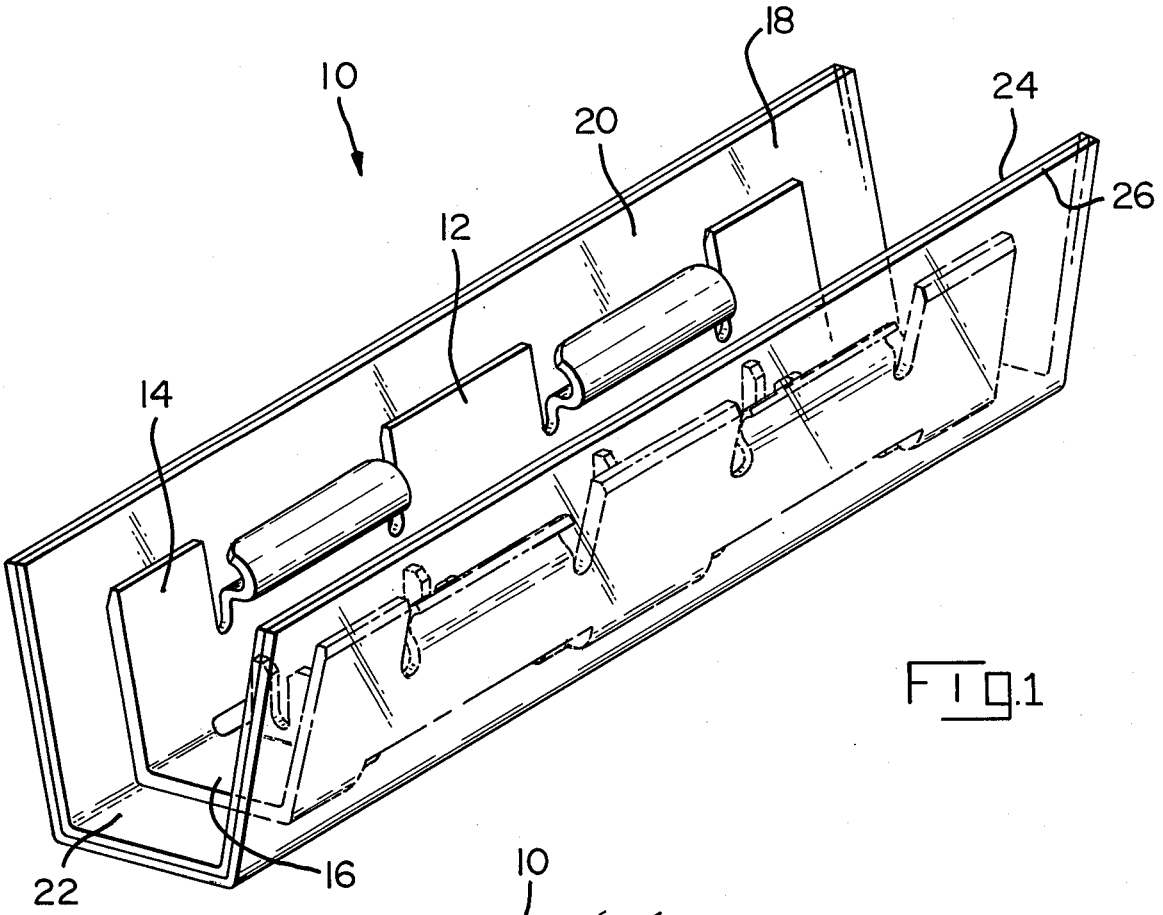
FIG. 1 is a three dimensional view of a preinsulated crimpable ferrule-type electrical connector according to the invention.

Referring now to FIG. 1, a preinsulated crimpable ferrule-type electrical connector 10 is comprised of the ferrule 12 partially surrounded by an insulating sheath 18. The sheath 18 is a two layer laminate comprised of an inner paperlike layer of heat resistant polyamide 24 bonded to an outer layer of tetrafluoroethylene film 26. The inner layer 24 is against the ferrule 12. The sides of the sheath 18 extend beyond the sides 14 of the ferrule 12. The ends 22 of the sheath 18 extend beyond the ends 16 of the ferrule.

Figure 2:
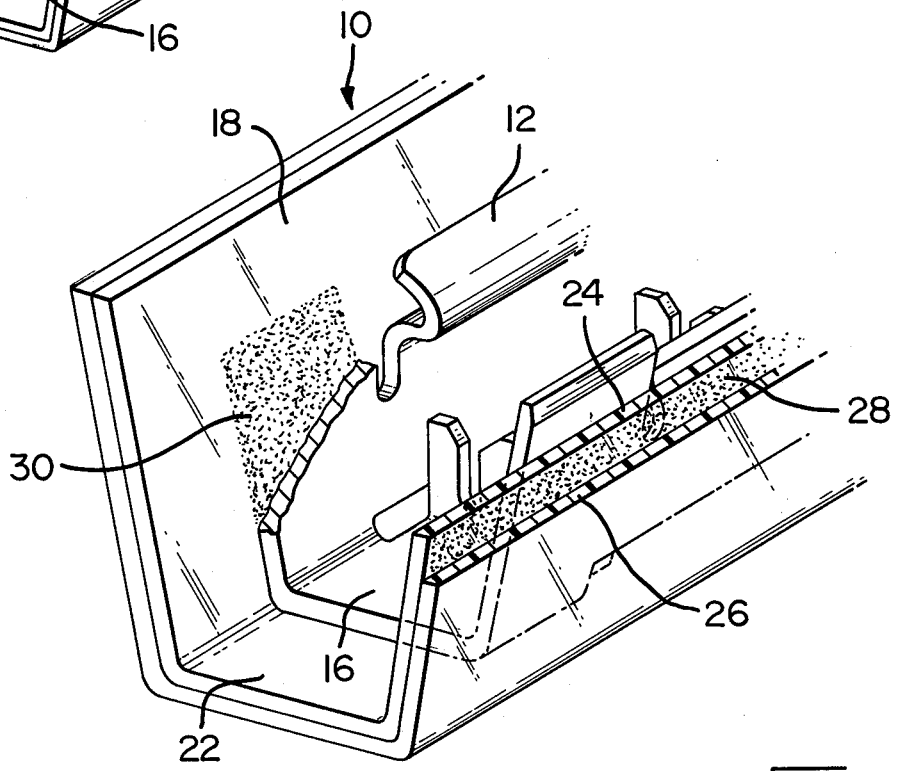
FIG. 2 is a three dimensional fragmentary view illustrating the construction of the connector in FIG. 1.
Figure 3:
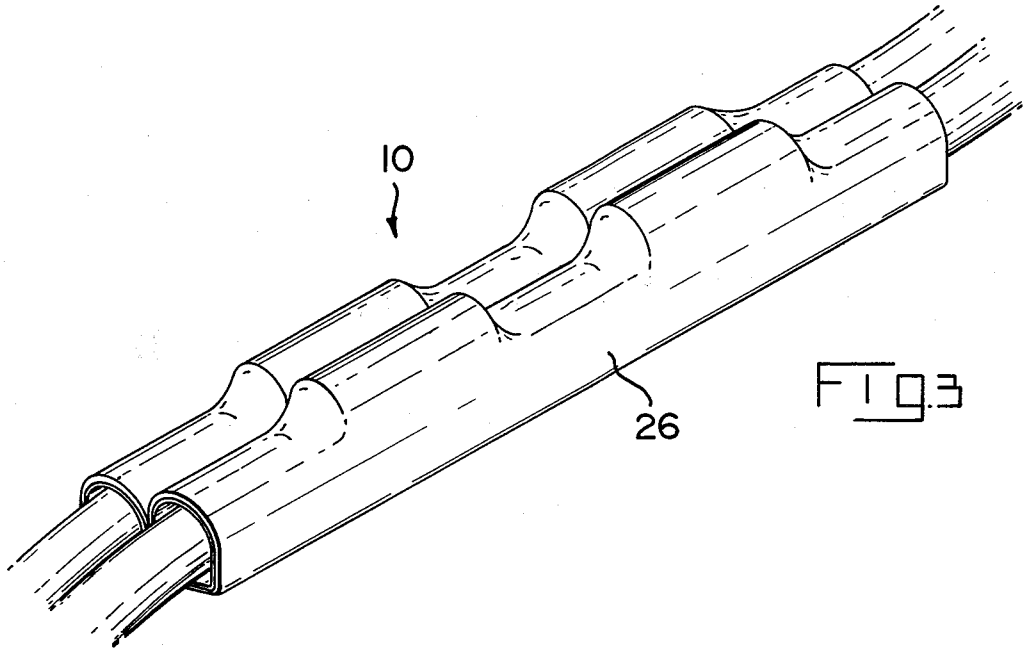
FIG. 3 is a three dimensional view of the connector in FIG. 1, after crimping.

Referring now to FIG. 2, a laminate 18 is formed by adhering the inner layer 24 to the outer layer 26 with an adhesive 28. The ferrule 12 is adhered to the laminate 18 with adhesive 30. When the connector 10 is crimped, as shown in FIG. 3, the sheath 18 follows the ferrule 12, the inner layer 24 provides support for the outer layer 26 of the sheath and the connector is completely surrounded by the outer layer 26.

Figure 4:
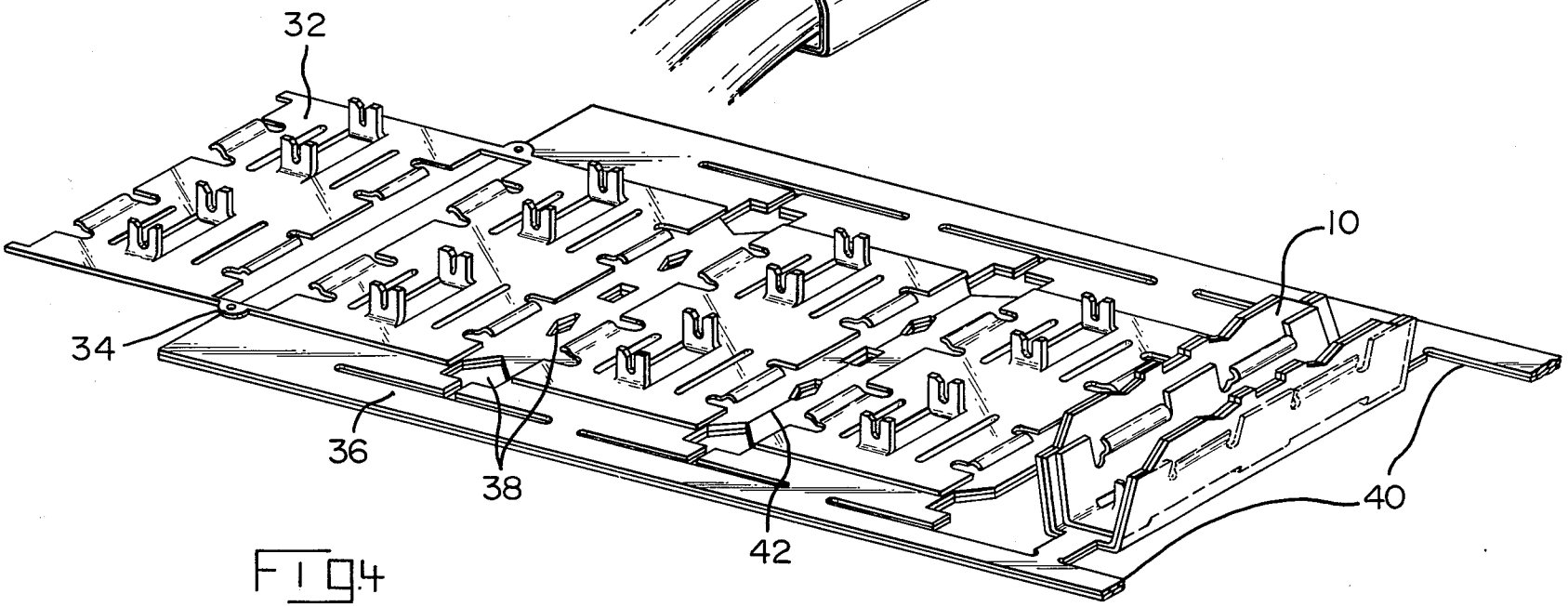
FIG. 4 is a perspective view of the progressive steps used in manufacturing the connector of FIG. 1.

The manufacturing process is illustrated in FIG. 4. The strip 32 of essentially flat connector blanks is adhered to a strip 36 of sheath material. The strip of blanks 32 is positioned on the sheath strip 36 so that the sheath extends beyond the edges of the connector blanks. The adhered strips are than stamped to remove the carrier portion 34 from the connector blank strip and portions 38 from the sheath strip. At the same time the sheath strip 36 is profiled to form carrier strips 40 along its outer edges. The insulating strip is cut at 42 to form individual connector sections. Each individual section is then formed into the connector 10. The resulting strip of formed connectors is fed onto a reel or through a cutting process which removes the connectors from the carrier strips.

An insulating sheath for connectors of this type must meet certain physical and mechanical criteria. It must have a dielectric strength of at least 750 volts. It also must be sufficiently flexible yet have sufficient impact strength to withstand the force exerted in forming the connector. Furthermore, it should also possess sufficient tensile strength to withstand a crimping force in excess of 7,000 psi.

In addition to the above criteria, the herein disclosed insulating material had to be compatible with the present manufacturing process and the crimping equipment used with the current product.

The insulating materials used in the original connectors were polyester films such as a polyethylene terephthalate. These films, however, do not have the minimum required L.O.I. value of 28.

In accordance with the principles of the invention, the herein disclosed laminate meets all of the criteria. The laminate has an L.O.I. value in excess of 28. It has a higher melting point than the polyesters used on the current product. When subjected to fire, the laminate chars but does not melt and flow from the connector. Telephone and other communications, therefore, will not be immediately interrupted in case of a fire.

While tetrafluoroethylene film has an LOI value in excess of 28, the film when used alone, is not compatible with the current manufacturing process. Its surface is slick and will not adhere well to the metal, it is too flexible to cut well, and will not withstand the crimping force. Tetrafluoroethylene film is available as TEFLON from E. I. DuPont de Nemours Company.

Aromatic polyamides when used alone are only partially compatible with the current manufacturing process. Connectors insulated with fully calendered and mica filled polyamides fracture when connectors are formed. Although connectors insulated with partially calendered polyamide do not fracture as readily during forming as the fully calendered or mica filled, the LOI values of the connectors only marginally meet the minimum required standard. The paperlike heat resistant aromatic polyamide is available as NOMEX aramid paper from DuPont.

The dual laminate dielectric film formed from these two materials, however, is compatible with the manufacturing process and gave unusual and unexpected results. The tetrafluoroethylene film provides a sufficiently high LOI value and tensile strength, while the polyamide provides the sturdiness required to process the sheath in manufacturing. Furthermore, the tetrafluoroethylene film can be bonded to the polyamide using methods known in the industry. The polyamide can be bonded to the metal using nitrophenolic or polyethylene acrylic based adhesives.

The connector manufactured according to the invention can be used in temperatures ranging from 40° to 140° F. Samples of connectors were subjected to environmental testing consisting of twelve hour cycles during which the relative humidity is maintained at 95% while the temperature is varied from 40° F. to 140° F. The cycle includes a two hour holding period at the two temperature extremes. In order to pass the test, products must remain stable for at least six cycles. Samples of connectors manufactured according to the invention exhibited no cracking nor degradation after ten cycles. In addition, the connectors are inert to the standard chemicals used by industry for cleaning its equipment.

The invention is described by way of example only. The connectors 10 are only exemplary of the many types of preinsulated crimpable ferrule type connectors.

What is claimed is:

1. A preinsulated crimpable ferrule type electrical connector comprised of an insulated sheath partially surrounding a ferrule, the insulated sheath being characterized in that:

the sheath is a two layer laminate comprised of a paperlike layer of a heat resistant thermosetting polyamide that will not melt and flow when subjected to fire bonded to a layer of tetrafluoroethylene film, the polyamide layer is the inner layer of the sheath and is against the ferrule to promote adhesion of the laminate to the ferrule, and the tetrafluoroethylene layer is the outer layer of the sheath, whereby upon crimping onto wires the polyamide layer provides support for the tetrafluoroethylene layer as the sheath follows the ferrule thus escasing the polyamide layer inside the tetrafluoroethylene layer.

2. A preinsulated crimpable ferrule type electrical connector as set forth in claim 1 characterized in that the polyamide layer is partially calendered.

3. A preinsulated crimpable ferrule type electrical connector as set forth in claim 1 characterized in that the connector has a minimum Limiting Oxygen Index value of 28.

4. A preinsulated crimpable ferrule type electrical connector as set forth in claim 1 characterized in that the sheath extends beyond the ends of the ferrule.

5. A preinsulated crimpable ferrule type electrical connectors as set forth in claim 1 characterized in that the connectors are in a ladder strip.

6. A method for manufacturing a strip of preinsulated crimpable ferrule type electrical connectors, the connectors being comprised of an insulating sheath partially surrounding a ferrule, the method being characterized in that the steps include:

adhering a strip of insulating sheath comprised of a layer of tetrafluoroethylene bonded to a layer of heat resistant aromatic thermosetting polyamide to a strip of essentially flat connector blanks, whereby the polyamide layer will not melt and flow when subjected to fire, positioning the blanks on the polyamide layer so that the sheath extends beyond the ends of the ferrule, whereby the polyamide layer promotes adhesion of the laminate to the ferrule removing portions of the sheath strip and connector strips to form a ladder strip of individual blanks attached to carrier strips of the sheath, and forming the blanks into connectors having the insulated sides of the connectors extending upwards from the plane of the strip.

* * * * *